US009482971B2

(12) United States Patent
Suzuki et al.

(10) Patent No.: US 9,482,971 B2
(45) Date of Patent: Nov. 1, 2016

(54) WHITE TONER, AND IMAGE FORMING METHOD AND IMAGE FORMING APPARATUS USING THE WHITE TONER

(71) Applicants: Kazumi Suzuki, Shizuoka (JP); Hisashi Nakajima, Shizuoka (JP); Masashi Nagayama, Shizuoka (JP); Saori Yamada, Shizuoka (JP); Yoshitaka Yamauchi, Shizuoka (JP); Yu Naito, Shizuoka (JP)

(72) Inventors: Kazumi Suzuki, Shizuoka (JP); Hisashi Nakajima, Shizuoka (JP); Masashi Nagayama, Shizuoka (JP); Saori Yamada, Shizuoka (JP); Yoshitaka Yamauchi, Shizuoka (JP); Yu Naito, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/624,988

(22) Filed: Feb. 18, 2015

(65) Prior Publication Data

US 2015/0253685 A1 Sep. 10, 2015

(30) Foreign Application Priority Data

Mar. 10, 2014 (JP) ..... 2014-046501

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 9/097*** | (2006.01) |

(52) U.S. Cl.

CPC ..... *G03G 9/0821* (2013.01); *G03G 9/08755* (2013.01); *G03G 9/08795* (2013.01); *G03G 9/08797* (2013.01); *G03G 9/0902* (2013.01); *G03G 9/09783* (2013.01)

(58) Field of Classification Search

CPC ..... G03G 9/0902; G03G 9/087

See application file for complete search history.

(56) References Cited

U.S. PATENT DOCUMENTS

| | | | | |
|---|---|---|---|---|
| 2004/0058260 | A1 | 3/2004 | Katoh et al. | |
| 2008/0292985 | A1 | 11/2008 | Suzuki et al. | |
| 2009/0317738 | A1 | 12/2009 | Honda et al. | |
| 2011/0008723 | A1 | 1/2011 | Morita et al. | |
| 2011/0052882 | A1* | 3/2011 | Gong | G03G 9/0812 428/195.1 |
| 2011/0177447 | A1 | 7/2011 | Suzuki et al. | |
| 2011/0183247 | A1* | 7/2011 | Kadokura | G03G 9/0827 430/105 |
| 2012/0189950 | A1* | 7/2012 | Sugitate | G03G 15/0879 430/105 |
| 2012/0237868 | A1* | 9/2012 | Yamada | G03G 9/0821 430/108.21 |

FOREIGN PATENT DOCUMENTS

| | | |
|---|---|---|
| JP | 1-105962 | 4/1989 |
| JP | 5-107798 | 4/1993 |
| JP | 2000-056514 | 2/2000 |
| JP | 2000-250258 | 9/2000 |
| JP | 2006-220694 | 8/2006 |
| JP | 2007-163839 | 6/2007 |
| JP | 2008-165017 | 7/2008 |
| JP | 2009-134060 | 6/2009 |
| JP | 2010-008816 | 1/2010 |
| JP | 2012-150411 | 8/2012 |
| JP | 2012-177763 | 9/2012 |
| JP | 2013-109097 | 6/2013 |

OTHER PUBLICATIONS

Extended European Search Report issued on Jul. 3, 2015 in Patent Application No. 15158264.0.

* cited by examiner

*Primary Examiner* — Hoa V Le

(74) *Attorney, Agent, or Firm* — Oblon, McClelland, Maier & Neustadt, L.L.P.

(57) ABSTRACT

A white toner has a first temperature range not less than 25° C. in which 60° glossiness is 10 or less between a fixable minimum temperature and a fixable maximum temperature thereof. The white toner has a second temperature range not less than 25° C. in which 60° glossiness is from 30 to 60 therebetween.

20 Claims, 7 Drawing Sheets

WHITE TONER, AND IMAGE FORMING METHOD AND IMAGE FORMING APPARATUS USING THE WHITE TONER

CROSS-REFERENCE TO RELATED APPLICATIONS

This patent application is based on and claims priority pursuant to 35 U.S.C. §119 to Japanese Patent Application No. 2014-046501, filed on Mar. 10, 2014, in the Japan Patent Office, the entire disclosure of which is hereby incorporated by reference herein.

BACKGROUND

1. Technical Field

The present invention relates to a white toner used for electrophotographic image forming process, more particularly to a white toner capable of forming both of a high gloss image and a low gloss image, and to an image forming method and an image apparatus using the white toner.

2. Description of the Related Art

Full-color images using four colors of yellow, magenta, cyan, and black have been widely used in recent years although electrophotographic images are generally printed in black. In such a case, an image is formed on a white substrate such as paper by using these four color toners. However, good coloring image are not obtained on a colored substrate such as black paper or colored paper or a transparent substrate such as a transparent film by using only four color toners. For this reason, Japanese published unexamined application No. JP-2006-220694-A discloses a method of using white toner as the fifth color toner to make a white background image.

White toner is used to make a white background on a black or colored substrate such as paper, or used for a white background of a transparent substrate such as film. In this case, the white toner is required to have masking characteristics. The masking characteristics mean the ability to hide what exists below the background on which the white toner is fixed. In the case of white color, only a fixed white toner is used for white coloring and it is therefore necessary to scatter and reflect all incident light. If there is a little transmissive light, the obtained image is not vivid or clear. To solve this problem, for example, Japanese published unexamined applications Nos. JP-H01-105962-A and JP-2000-056514-A disclose improving masking characteristics.

On the other hand, in the white image market, it is known that preferred gloss is different according to applications as white offset ink includes high gloss grade and low gloss grade. In the printing field, inks are exchanged to obtain desired glossiness. However, the electrophotography can comply with only a limited application, since it is difficult to exchange a toner for each application because processes from providing a toner to forming images are complicated.

SUMMARY

Accordingly, one object of the present invention is to provide a white toner capable of producing a high gloss image and a low gloss image without needing plural grade supplies and exchanging toners.

Another object of the present invention is to provide an image forming method using the white toner.

A further object of the present invention is to provide an image forming apparatus using the white toner.

These objects and other objects of the present invention, either individually or collectively, have been satisfied by the discovery of a white toner, including a first temperature range not less than 25° C. in which 60° glossiness is 10 or less between a fixable minimum temperature and a fixable maximum temperature thereof; and a second temperature range not less than 25° C. in which 60° glossiness is from 30 to 60 therebetween.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
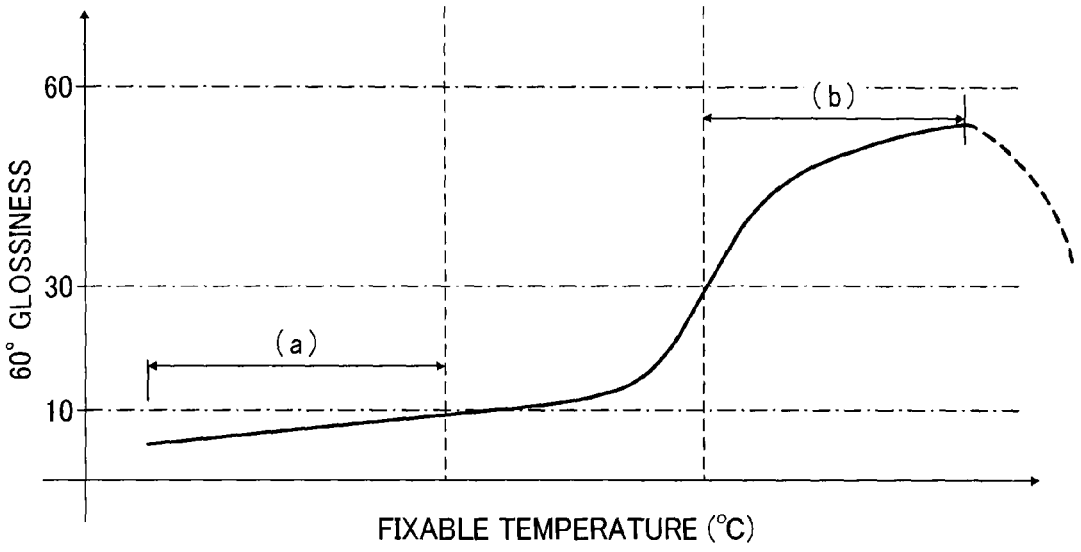
FIG. 1 is a diagram showing an example of 60° glossiness variation of the white toner of the present invention.

The present invention provides a white toner capable of producing a high gloss image and a low gloss image without needing plural grade supplies and exchanging toners.

More particularly, the present invention relates to a white toner, including a first temperature range not less than 25° C. in which 60° glossiness is 10 or less between a fixable minimum temperature and a fixable maximum temperature thereof; and a second temperature range not less than 25° C. in which 60° glossiness is from 30 to 60 therebetween.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a diagram showing an example of 60° glossiness variation of the white toner between a fixable minimum temperature and a fixable maximum temperature thereof of the present invention.

(a) a temperature range not less than 25° C. in which 60° glossiness is 10 or less (b) a temperature range not less than 25° C. in which 60° glossiness is from 30 to 60

When fixed at the temperature range (a), a low gloss white image is produced. When fixed at the temperature range (b), a high gloss white image is produced. A high gloss image and a low gloss image can be formed without exchanging a toner. When a high gloss white image and low gloss white image are formed, the toner image can be fixed so as to have desired glossiness because both of them have sufficient fixable temperature range. A fixer typically has a temperature control range about ±10°, the temperature range of 25° C. forms a sufficient fixable temperature range.

The temperature ranges in which 60° glossiness is 10 or less and from 30 to 60 are preferably from 30 to 40° C., and 25 to 30° C., respectively to obtain sufficient fixable temperature.

The toner of the present invention is a white toner including at least 2 binder resins, a tri- or more valent metal salt and titanium dioxide white pigment. The first binder resin has a weight-average molecular weight of from 6,000 to 14,000, and the second binder resin of from 25,000 to 90,000. The first binder resin has an acid value not greater than 12 mg KOH/g, and the second binder resin not less than 20 mg KOH/g. A weight ratio of the first binder resin to the second binder resin is preferably from 70/30 to 90/10.

Figure 2A:
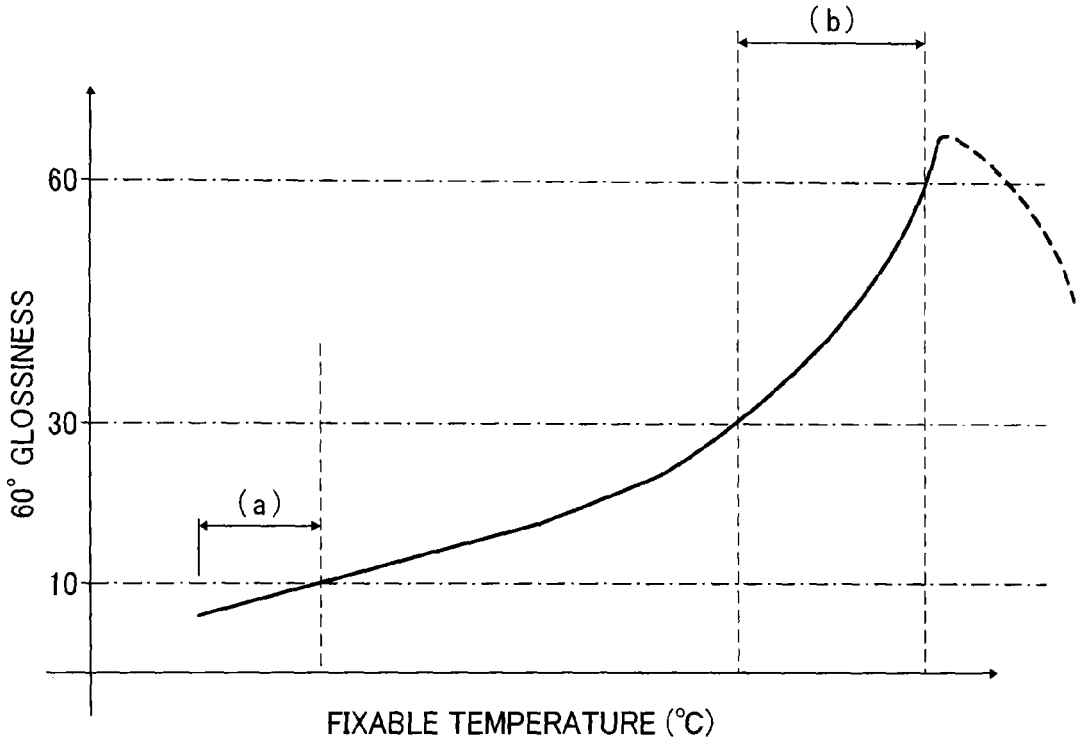
FIG. 2A is a diagram showing an example of a temperature range in which 60° glossiness of from 30 to 60 is less than 25° C.
Figure 2B:
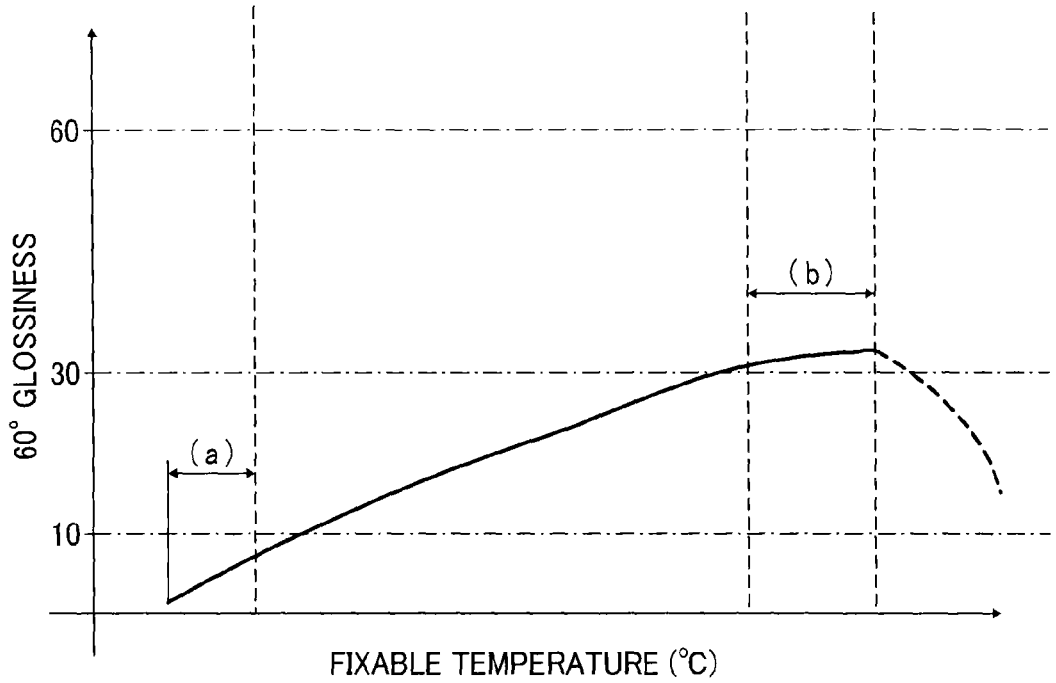
FIG. 2B is a diagram showing an example of a temperature range in which 60° glossiness not greater than 10 is less than 25° C.

The tri- or more valent metal salt and the acid values of the binder resins control curves in a diagram showing a relation between the fixable temperature and 60° glossiness. Particularly when the second binder resin has an acid value less than 20 mg KOH/g, the temperature range in which 60° glossiness is from 30 to 60 tends to be narrow as FIG. 2A shows. A combination of the tri- or more valent metal salt and a resin having a high acid value works as a pseudo-crosslinking point at a high-temperature area. When the first binder resin has a high acid value, a pseudo crosslinking occurs at low temperature, and the temperature range in which 60° glossiness is from 30 to 60 tends to be narrow as FIG. 2B shows.

Toner materials for use in the white toner of the present invention are described in order.

[White Pigment]

A titanium dioxide pigment is preferably used as the white pigment for use in the present invention.

Moreover, the titanium dioxide pigment is preferably surface-treated with at least a polyol and more preferably coated with at least aluminum, trimethylol propane, and/or trimethylol ethane.

These surface-treated pigments are available from the market and specific examples thereof include, but are not limited to, TIPAQUE PF-739, CR-50-2, and TIPAQUE CR-60-2 (manufactured by Ishihara Sangyo Kaisha Ltd.). Among these, TIPAQUE PF-739 is preferable because the amount of moisture absorption thereof is limited by zirconia treatment. The white pigment preferably has a volume-average particle diameter of from 200 to 300 nm.

The white pigment having a volume-average particle diameter not less than 200 nm does not increase influence on the properties of the binder resin. When not greater than 300 nm, the masking ability itself does not deteriorate. The white pigment more preferably has a volume-average particle diameter of from 220 to 270 nm.

A toner preferably includes the white pigment in an amount of from 37 to 45% by weight. When not less than 37% b weight, the white pigment has sufficient masking ability and even influences on thermal properties of the toner. When not greater than 45% by weight, the white pigment does not influence on thermal properties of the toner so much, and the toner does not have too high viscoelasticity to control image glossiness.

[Binder Resin]

The binder resin included in the white toner of the present invention is not particularly limited, and conventionally known resins can be used.

The white toner of the present invention includes at least 2 binder resins. The first binder resin has a weight-average molecular weight of from 6,000 to 14,000, and the second binder resin of from 25,000 to 90,000. The first binder resin has an acid value not greater than 12 mg KOH/g, and the second binder resin not less than 20 mg KOH/g. A weight ratio of the first binder resin to the second binder resin is preferably from 70/30 to 90/10.

When a low-molecular-weight resin of the first binder resin having a weight-average molecular weight of from 6,000 to 14,000 has an acid value greater than 12 mg KOH/g, 60° glossiness does not increase due to interaction with the trivalent metal salt, resulting in difficulty of producing high gloss images. The first binder resin preferably has an acid value not less than 0.1 mg KOH/g.

When a polymeric resin of the second binder resin having a weight-average molecular weight of from 25,000 to 90,000 has an acid value less than 20 mg KOH/g, inclination of glossiness variation at high gloss increases, resulting in difficulty of producing images having stable gloss.

The second binder resin preferably has an acid value not greater than 40 mg KOH/g to produce high gloss images more easily or produce stable images without narrowing the fixable temperature range to produce high gloss images.

The first binder resin lowers melt viscosity of the toner to produce high gloss images. When the first binder resin has a weight-average molecular weight less than 6,000, the toner does not have sufficient heat resistant preservability and mechanical strength. When greater than 14,000, the melt viscosity increases, resulting in difficulty of producing high gloss images.

The second binder resin prevents hot offset. When the second binder resin has a weight-average molecular weight less than 25,000, the temperature range of high gloss area narrows. When greater than 90,000, it is difficult to produce high gloss images.

When the weight ratio of the first binder resin to the second binder resin is less than 70/30, it is difficult to produce high gloss images. When greater than 90/10, hot offset tends to occur.

A polyester resin is preferably used for each of the first and second binder resins.

The binder resin of the present invention is described exemplifying polyester resins.

Monomers forming the polyester resin include the followings.

Specific examples of dihydric alcohol include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or diols obtained by polymerizing a cyclic ether such as ethylene oxide or propylene oxide with bisphenol A.

It is preferable to use a tri- or more polyhydric alcohol in combination to cross-link the polyester resin.

Specific examples of the tri- or more polyhydric alcohols include, but are not limited to, sorbitol, 1,2,3,6-hexanetetrol, 1,4-sorbitan, pentaerythritol for example, dipentaerythritol and tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Specific examples of acid components used to form the polyester polymer include, but are not limited to, benzene dicarboxylic acids such as phthalic acid, isophthalic acid, and terephthalic acid or their anhydrides, alkyl dicarboxylic acids such as succinic acid, adipic acid, sebacic acid, and azelaic acid, or their anhydrides, unsaturated dibasic acids such as maleic acid, citraconic acid, itaconic acid, alkenylsuccinic acid, fumaric acid, and mesaconic acid, unsaturated dibasic acid anhydrides such as maleic acid anhydride, citraconic acid anhydride, itaconic acid anhydride, and alkenylsuccinic acid anhydride. Also, examples of trivalent or more polyvalent carboxylic acid components include trimellitic acid, pyromellitic acid, 1,2,4-benzenetricarboxylic acid, 1,2,5-benzenetricarboxylic acid, 2,5,7-naphthalene tricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra (methylene carboxy)methane, 1,2,7,8-octanetetracarboxylic acid, En Pol trimer acid, or their anhydrides or partially lower-alkyl esters.

Even when the polyester resin and other binder resins such as vinyl resins are used together, resins having a low weight-average molecular weight of from 6,000 to 14,000 preferably has an acid value of from 0.1 to 12 mg KOH/g, and resins having a high weight-average molecular weight of from 25,000 to 90,000 preferably has an acid value of from 20 to 40 mg KOH/g as well.

In the present invention, the acid value of the binder resin of the toner composition is obtained by the following method. Its basic procedures are based on JIS K-0070.

[1] With regard to the sample, additives are removed or the contents and the acid values of the resin and the component other than the resin are obtained in advance.

A sample pulverized product is weighed precisely in an amount of 0.5 g to 2.0 g to find the weight W (g) of the polymer component. To obtain the acid value of the binder resin from the toner, for example, the acid values and contents of a colorant, magnetic body or the like are measured separately to find the acid value of the binder resin by calculation.

[2] The sample is placed into a 300 ml beaker and 150 ml of a liquid mixture of toluene/ethanol (ratio by volume: 4/1) is added to dissolve the sample.

[3] An ethanol solution of 0.1 mol/l of KOH is used to titrate by using a potentiometric titrator.

[4] The amount of the KOH solution is S (ml) and at the same time, a control (blank) is measured to find the amount of the KOH solution used as B (ml) to calculate the acid value using the following formula (1). In the formula (1), f represents a factor of KOH.

$$\text{Acid value(mg KOH/g)}=[(S-B)\times f\times 5.61]/W \quad (1)$$

The polyester resin preferably has a glass transition temperature (Tg) of from 40 to 80° C. and more preferably from 40 to 75° C. in terms of the toner preservability. When Tg is too low, the toner tends to deteriorate a high-temperature atmosphere and also, offset tends to occur in the fixing process. When Tg is excessively high, the fixability easily deteriorates.

Also, in the toner of the present invention, the polyester resin preferably includes a crystalline polyester which has at least a urethane/urea-modified portion and a melting point of from 60 to 110° C.

When a crystalline polyester having a sharp endothermic curve and an endothermic peak in a temperature range from 60 to 110° C. is used, it is possible to improve both the low-temperature fixability and heat resistant preservability of the toner. It is more preferable when the endothermic peak temperature is 65 to 75° C.

It is preferable to synthesize the crystalline polyester by using a saturated aliphatic diol compound having 2 to 12 carbon atoms, and particularly, 1,4-butanediol, 1,6-hexanediol, 1,8-octanediol, 1,10-decanediol, 1,12-dodecanediol, and their derivatives as an alcohol component and a dicarboxylic acid having a double bond (C═C bond) and 2 to 12 carbon atoms or a saturated dicarboxylic acid having 2 to 12 carbon atoms and particularly fumaric acid, 1,4-butanedioic acid, 1,6-hexanedioic acid, 1,8-octanedioic acid, 1,10-decanedioic acid, 1,12-dodecanedioic acid, and their derivatives as at least an acidic component.

In particular, the crystalline polyester resin is preferably constituted of only one alcohol component selected from 1,4-butanediol, 1,6-hexanediol, 1,8-octanediol, 1,10-decanediol, and 1,12-dodecanediol and only one dicarboxylic acid component selected from fumaric acid, 1,4-butanedioic acid, 1,6-hexanedioic acid, 1,8-octanedioic acid, 1,10-decanedioic acid, and 1,12-dodecanedioic acid in terms of reducing the difference between the endothermic peak temperature and the endothermic shoulder temperature.

[Tri- or More Valent Metal Salt]

The toner of the present invention preferably includes a tri- or more valent metal salt. The metal salt crosslinks with an acidic group of the binder resin when fixed and forms a weak 3-dimensional crosslink to maintain low-temperature fixability and obtain hot offset resistance.

The metal salt is preferably at least one of metal salts of salicylic acid derivatives and acetylacetonate metal salts. The metal is not particularly limited so long as it is a tri- or more valent polyvalent ionic metal such as iron, zirconium, aluminum, titanium and nickel.

Tri- or more valent salicylic acid metal compounds are preferably used as the ti- or more valent metal salt.

The toner preferably includes the metal salt in an amount of from 0.5 to 2 parts by weight, and more preferably from 0.5 to 1 part by weight. When less than 0.5 parts by weight, the toner may deteriorate in hot offset resistance. When greater than 2 parts by weight, the toner has good hot offset resistance, but may deteriorate in producing glossy images.

[Release Agent]

The toner of the present invention preferably includes a release agent besides the binder resin, titanium dioxide white pigment and the tri- or more valent metal salt. Specific examples of the release agent include, but are not limited to, fatty acid esters, esters of aromatic acids such as phthalic acid, phosphate, maleate, fumarate, itaconate, other esters, benzyl, benzoin compounds, ketones such as benzoyl compounds, hindered phenol compounds, benzotriazole compounds, aromatic sulfonamide compounds, aliphatic amide compounds, long-chain alcohols, long-chain dialcohols, long-chain carboxylic acids, and long-chain dicarboxylic acids.

More specifically, dimethyl fumarate, monoethyl fumarate, monobutyl fumarate, monomethyl itaconate, monobutyl itaconate, diphenyl adipate, dibenzyl terephthalate, dibenzyl isophthalate, benzyl, benzoin isopropyl ether, 4-benzoylbiphenyl, 4-benzoyl diphenyl ether, 2-benzoylnaphthalene, dibenzoylmethane, 4-biphenylcarboxylic acid, stearylstearic acid amide, oleylstearic acid amide, stearin oleic acid amide, octadecanol, n-octyl alcohol, tetracosanoic acid, eicosanoic acid, stearic acid, lauric acid, nonadecanoic acid, palmitic acid, hydroxy octanoic acid, docosanoic acid, and compounds represented by the formulae (1) to (17) disclosed in Japanese published unexamined application No. JP-2002-105414-A, etc. can be used Further, natural waxes, for example, vegetable waxes such as carnauba wax, cotton wax, tallow, and rice wax; animal waxes such as beeswax and lanolin; mineral waxes such as ozokerite and selsyn; and petroleum waxes such as paraffin wax, microcrystalline wax, and petrolatum can be used. Besides these natural waxes, synthetic hydrocarbon waxes such as Fisher-Tropsch wax and polyethylene wax; and synthetic waxes such as esters, ketones, and ethers can also be used. Moreover, fatty acid amides such as 12-hydroxystearic acid amide, stearic acid amide, phthalic acid imide anhydride, and chlorinated hydrocarbons; low-molecular crystalline polymer resins, for example, homopolymers and copolymers of polyacrylates such as a poly-n-stearylmethacrylate and poly-n-laurylmethacrylate (for example, a copolymer of n-stearylacrylate ethylmethacrylate); and crystalline polymers having a long alkyl group on the side chain are also usable.

These compounds can be used alone or in combination.

Particularly, the toner preferably includes monoester wax as a release agent. Monoester wax has low compatibility with a typical binder resin and easily exudes on the surface when the toner is fixed. Therefore, the toner has high releasability, high gloss and high low-temperature fixability.

The toner preferably includes the monoester wax in an amount of from 4 to 8 parts by weight, and more preferably from 5 to 7 parts by weight per 100 parts of resins besides a pigment in the toner. When less than 4 parts by weight, the monoester wax does not sufficiently exude, and the toner has poor releasability and occasionally deteriorates in gloss, low-temperature fixability and hot offset resistance. When greater than 8 parts by weight, the monoester wax exudes too much, and the toner has poor preservability and occasionally deteriorates in filming resistance over photoconductors, etc.

A synthetic ester wax is preferably used as the monoester wax. The synthetic ester wax is formed by synthesizing a long straight chain saturated fatty acid and a long straight chain saturated alcohol. The long straight chain saturated fatty acid represented by a formula $C_nH_{2n+1}COOH$ in which n is 5 to 28 is preferably used. The long straight chain saturated alcohol represented by a formula $C_nH_{2n+1}OH$ in which n is 5 to 28 is preferably used.

Specific examples of the long straight chain saturated fatty acid include, but are not limited to, caproic acid, undecylic acid, lauric acid, tridecylic acid, myristic acid, pentadecylic acid, palmitic acid, heptadecanic acid, tetradecanic acid, stearic acid, nonadecanic acid, aramonic acid, behenic acid, lignoceric acid, cerotic acid, heptacosanoic acid, montanic acid and melissic acid. Specific examples of the long straight chain saturated alcohol include, but are not limited to, amyl alcohol, hexyl alcohol, heptyl alcohol, octyl alcohol, caprylic alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol and heptadecanol. These may have substituents such as a lower alkyl group, an amino group and halogen.

The toner of the present invention preferably includes a wax dispersant. The dispersant is preferably a copolymer composition and the copolymer composition with polyethylene as an adduct including at least styrene, butylacrylate and acrylonitrile as monomers.

A styrene resin has better compatibility with a typical wax than the polyester that is a binder resin of the toner of the present invention, and the wax is not dispersed well. Further, the styrene resin has low inner cohesive power and better pulverizability than the polyester. Therefore, even when a wax is similarly dispersed, as the polyester, possibility that an interface between the wax and the resin is a pulverized surface is low, which prevents a wax from being present at the surface of a toner and increases preservability thereof.

The polyester that is a binder resin of the toner of the present invention and a styrene resin are incompatible with each other, and the toner is likely to have low gloss.

In the present invention, butylacrylate having a SP value close to that of polyester in typical styrene resins prevents gloss from lowering even when incompatible therewith. Butylacrylate has thermal properties close to those of polyester and does not largely deteriorate low-temperature fixability and inner cohesive power of polyester.

The toner preferably includes the wax dispersant in an amount not greater than 7 parts by weight. The wax dispersion effect of the wax dispersant stably improves preservability of the toner regardless of methods of preparing thereof. The wax dispersion effect downsizes the wax diameter to prevent filming over photoconductors. When greater than 7 parts by weight, components incompatible with polyester increase, resulting in occasional low gloss. Further, the wax has so high dispersibility that filming resistance improves, but the wax does not exude well on the surface of the toner when fixed, resulting in occasional deterioration of low-temperature fixability and hot offset resistance.

—Other Materials—

As materials other than the white pigment, the binder resin, and the organic low-molecular material, inorganic particulates are usable as an external additive to impart fluidity, developing ability, electrification characteristics, cleaning ability, and the like to the toner particles.

There is no specific limit to the inorganic particulates used as the external additives. Any known material is selectable. Specific examples of the inorganic particulates include, but are not limited to, silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. These compounds can be used alone or in combination.

The primary particle diameter of the inorganic particulates is preferably from 5 nm to 2 μm and more preferably from 5 nm to 500 nm. Also, the specific surface area of the inorganic particulates as measured by the BET method is preferably from 20 $m^2/g$ to 500 $m^2/g$.

The content of the inorganic particulates in the toner is preferably from 0.01% by weight to 5.0% by weight and more preferably from 0.01% by weight to 2.0% by weight. When the inorganic particulates are used as an external additive to improve, for example, the fluidity of the toner, such inorganic particulates are preferably surface-treated with a fluidity improver.

The fluidity improver improves the hydrophobicity of particles due to surface-treatment, thereby preventing the particles from deteriorating in fluidity and chargeability even in humid circumstances. Specific examples of the fluidity improver include, but are not limited to, a silane coupling agent, silylating agent, silane coupling agent having a fluorinated alkyl group, organic titanate type coupling agent, aluminum type coupling agent, silicone oil, and modified silicone oil. It is particularly preferable to use a hydrophobic silica or hydrophobic titanium oxide prepared by surface-treating the above-specified silica and titanium oxide with such a fluidity improver.

A cleaning improver that improves the cleanability of the toner is added to the toner to remove an un-transferred development agent remaining on a photoreceptor and a primary transfer medium. Specific examples of the cleaning improver include, but are not limited to, zinc stearate, calcium stearate, metal salts of fatty acids such as stearic acid, and polymer particulates produced by soap-free emulsion polymerization such as polymethylmethacrylate particulates and polystyrene particulates. Preferably, the polymer particulates have a relatively narrow particle size distribution and a volume average particle diameter of from 0.01 μm to 1 μm.

(Toner Preparation Method)

Conventional toner preparation methods are used to prepare the white toner of the present invention. Specifically, a binder resin, a titanium dioxide white pigment, a tri- or more valent metal salt, and optionally a release agent and an additive are fully mixed in a mixer such as Henschel Mixer and Super Mixer to prepare a mixture. The mixture is melted and kneaded in a het meting kneader such as a heat roll, a kneader and an extruder. The kneaded mixture is cooled to be solidified, pulverized and classified to prepare a toner. The pulverization methods includes a jet mill method involving a toner in a high-speed stream to collide against an impact plate to be pulverized, an inter-particle collision method in which toner particles collide against each other, and a mechanical pulverization method providing a toner in a narrow gap between a rotor and a stator.

When manufacturing the toner by the pulverization method, it is preferable to produce the toner through the melt-kneading process at a temperature at which the releasing agent is melted to obtain a kneaded material followed by the processes of pulverizing and classifying the kneaded material.

(Developer)

The white toner of the present invention can be used as a one-component development agent or two-component development agent.

When the toner of the present invention is used as a two-component development agent, the white toner can be mixed with a toner carrier made of magnetic particles (hereinafter also referred to as a carrier or a magnetic carrier). The ratio of the contents of the toner to the carrier in the development agent is preferably from 1 part by weight to 15 parts by weight of the toner to 100 parts by weight of the carrier.

Any known carrier can be used, which is, for example, iron powder, ferrite powder, magnetite powder, and magnetic resin carrier each having a particle diameter of from about 20 μm to about 200 μm.

Specific examples of coating materials for the magnetic carriers include, but are not limited to, amino type resins, for example, a urea-formaldehyde resin, melamine resin, benzoguanamine resin, urea resin, polyamide resin, and epoxy resin. Also, copolymers of polyvinyl or polyvinylidene resins, for example, an acryl resin, polymethylmethacrylate resin, polyacrylonitrile resin, polyvinyl acetate resin, polyvinyl alcohol resin, polyvinylbutyral resin, polystyrene type resins such as a polystyrene resin and styrene acryl copolymer resin, olefin halide resins such as a polyvinyl chloride, polyester type resins such as a polyethylene terephthalate resin and polybutylene terephthalate resin, polycarbonate type resins, polyethylene resin, polyvinyl fluoride resin, polyvinylidene fluoride resin, polytrifluoroethylene resin, polyhexafluoropropylene resin, copolymers of vinylidene fluoride and an acryl monomer, copolymers of vinylidene fluoride and vinyl fluoride, fluoro terpolymers such as a terpolymer of tetrafluoroethylene, vinylidene fluoride, and non-fluorinated monomer, and silicone resin may be used.

The coating resin optionally contains electroconductive powder. Metal powder, carbon black, titanium oxide, tin oxide, zinc oxide, or the like can be used as the electroconductive powder. These electroconductive powders preferably have an average particle diameter of 1 μm or less. When the average particle diameter is too large, it tend to be difficult to control the electric resistance.

As described above, the toner of the present invention can be used as a one-component development agent (magnetic toner or nonmagnetic toner) without a carrier.

(Printed Matter)

The printed matter of the present invention has at least a substrate on which an image is formed, a color image layer, and a white image layer formed using the white toner.

Specifically, a full-color chromatic image layer on a substrate formed of, for example, a transparent film is formed by electrophotography using yellow toner, cyan toner, magenta toner, and black toner. Thereafter, a solid white image layer (masking layer) is formed on the chromatic image layer by the white toner, followed by fixing to obtain a fixed printed matter. When this image is viewed from back, i.e., the substrate side, the image look highly glossy and high class. That is, since the surface of the transparent film is smooth, the image look very highly glossy regardless of the amount of the toner stuck. Moreover, the surface of this image is so smooth that external light (illumination light and natural light) reflected from the surface does not diffuse. As a consequence, the obtained image is very highly chromatic and high class to human eyes.

Also, a solid white image layer is formed on a transparent film or the like serving as a substrate by using the white toner followed by forming a full-color chromatic image layer on the reverse side of the white image layer by using yellow toner, cyan toner, magenta toner, and black toner to obtain a fixed printed matter.

In this manner, a vivid and clear printed matter having good color is obtained by printing a full-color image on a smoother substrate.

Also, a solid white image layer can be formed on at least a part of a transparent, black, or colored substrate (e.g., film or paper) followed by forming a full-color chromatic image layer on the white image layer to obtain a fixed printed matter. When a solid white image layer is formed on a substrate by using the white toner in this manner, the white image layer serves as a masking layer so that a full-color chromatic image can be produced irrespective of the color of the substrate.

In any event, glossiness representing smoothness of a white toner layer largely changes visibility of the printed matter. The smoother the white image layer (the higher the gloss), the higher the masking ability, and the resultant printed matter has higher chroma than a color image. When the while image layer has low gloss, less reflected light prevents glittering, and the resultant printed matter has good visibility although having low chroma.

The white toner of the present invention can be fixed at a temperature range in which 60° glossiness is not greater than 10 to produce a low gloss white image. The toner can be fixed at a temperature range in which 60° glossiness is from 3 to 60 to produce a high gloss white image.

The white toner of the present invention can form both of a low gloss white image and a high gloss white image alone.

(Image Forming Method)

Next, an image forming method using the white toner of the present invention is described.

The image forming method using the white toner of the present invention includes, for example, forming a full color chromatic image layer of yellow toner, magenta toner, cyan toner, and black toner on a transparent film serving as a substrate by electrophotography and forming a solid white image layer (masking layer) on the full color image by the white toner of the present invention to view the image from back, i.e., the reverse side of the image.

Also, a printed matter can be obtained by forming a solid image of the white toner on a transparent film first followed by forming a chromatic image thereon. Moreover, it is possible to form a full-color chromatic image on one side of a substrate and an image layer of the white toner on the other side.

The full-color chromatic image layer is formed by using a full-color image forming apparatus which conducts at least an electrostatic image forming step, a developing step, a transfer step, a fixing step, and a cleaning step and other optional steps such as a discharging step, a recycling step, and a control step using each toner of yellow, magenta, cyan, and black.

Next, a white toner image layer (masking layer) is formed on the entire surface of the transparent film on which the full-color image is formed using the white toner of the present invention by a separate image forming apparatus.

When an image formed on a transfer belt is transferred to a transparent film, for example, an image forming apparatus having development units for five color toners as described later forms a solid image of the white toner on a transfer belt first and thereafter a full color image of black, cyan, magenta, and yellow on the solid image followed by transferring the thus-obtained image to a transfer film from the image side.

By forming an image in such a manner, it is possible to view a highly contrasty full-color image from the reverse side thereof.

Forming images in an embodiment of the present invention is described with reference to the image forming apparatus of FIG. 3. An image forming apparatus 100 shown in FIG. 3 has a drum photoreceptor 10 serving as an image bearing member, a charge roller 20 serving as a charging device, beams of light 30 by an irradiator serving as an exposure device, a developing device 40 serving as a developing device, an intermediate transfer element 50, a cleaning blade 60 serving as a cleaning device, and a discharging lamp 70 serving as a discharging device.

Figure 3:
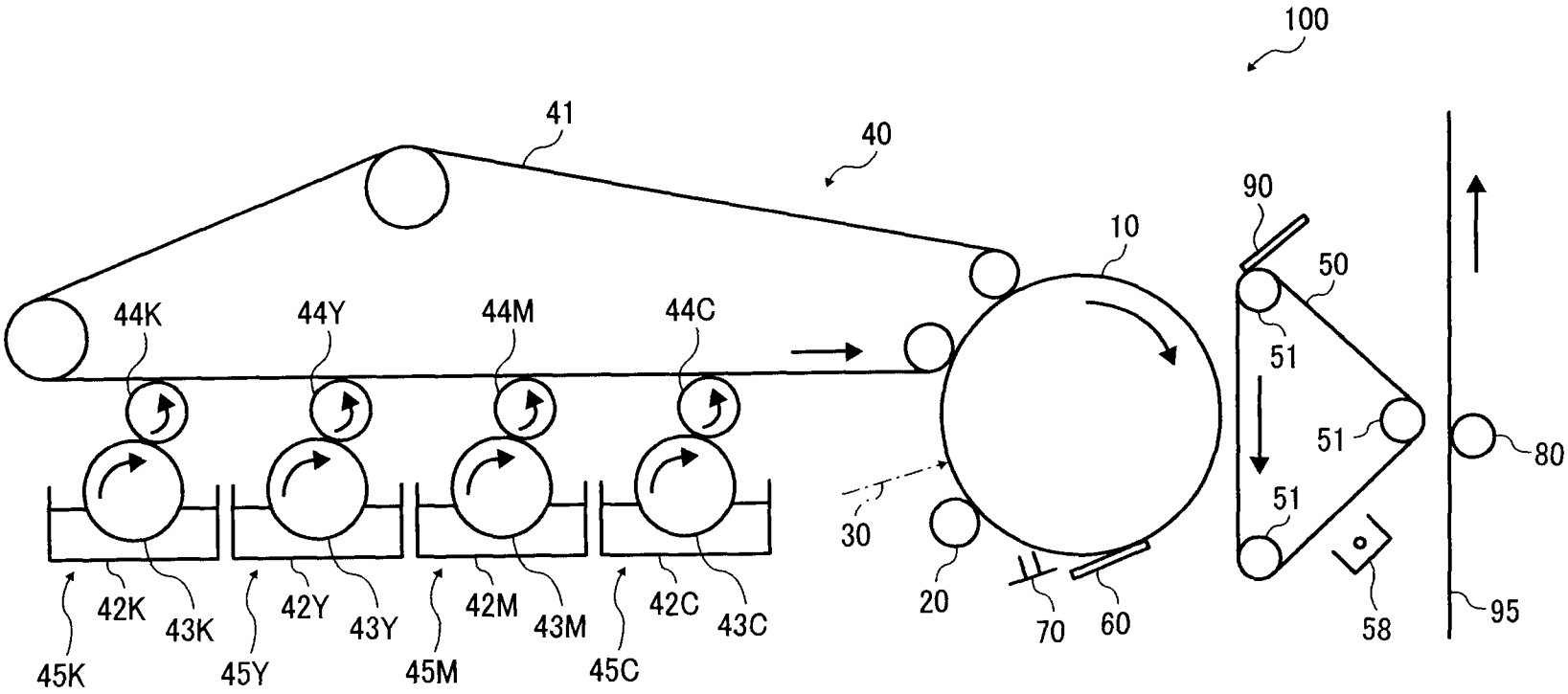
FIG. 3 is a schematic view illustrating an embodiment of the image forming apparatus of the present invention.

The intermediate transfer element 50 is an endless belt and designed to move in the direction indicated by an arrow in FIG. 3 by three rollers 51 arranged inside of the intermediate transfer element 50 to stretch the belt. It is possible to use at least one of these three rollers 51 as a transfer bias roller capable of applying a predetermined transfer bias (primary transfer bias) to the intermediate transfer element 50. Around the intermediate transfer element 50, there is arranged a cleaning blade 90, a transfer roller 80, and a corona charger 58. The transfer roller 80 serves as the transfer device and is provided facing the intermediate transfer element 50 to apply a transfer bias to secondarily transfer the visible image (toner image) to a recording medium 95. The corona charger 58 is provided upstream of the portion where the drum photoreceptor 10 contacts the intermediate transfer element 50 and downstream of the portion where the intermediate transfer element 50 contacts the recording medium 95 in the moving direction of the intermediate transfer element 50 to impart charge to the toner image on the intermediate transfer element 50.

The developing unit 40 has a developing belt 41 serving as a development agent bearing member, a black developing unit 45K, a yellow developing unit 45Y, a magenta developing unit 45M, and a cyan developing unit 45C each of which is arranged around the developing belt 41. The black developing unit 45K has a development agent accommodating unit 42K, a development agent supply roller 43K, and a developing roller 44K. The yellow developing unit 45Y has a development agent accommodating unit 42Y, a development agent supply roller 43Y, and a developing roller 44Y. The magenta developing unit 45M has a development agent accommodating unit 42M, a development agent supply roller 43M, and a developing roller 44M. The cyan developing unit 45C has a development agent accommodating unit 42C, a development agent supply roller 43C, and a developing roller 44C. Also, the developing belt 41 is an endless belt stretched in a rotatable manner by a plurality of belt rollers. Part of the developing belt is brought into contact with the drum photoreceptor 10.

In the image forming apparatus 100 illustrated in FIG. 3, for example, a charge roller 20 uniformly charges the drum photoreceptor 10. The exposure device irradiates the drum photoreceptor 10 with beans of light 30 according to obtained image data to form a latent electrostatic image. The latent electrostatic image formed on the drum photoreceptor 10 is developed by supplying toner from the developing device 40 to form a toner image. The toner image is transferred (primary transfer) to the intermediate transfer element 50 by the voltage applied from the roller 51 and is further transferred (secondary transfer) to the surface of the recording medium 95. As a result, a transfer image is formed on the recording medium 95. Residual toner on the drum photoreceptor 10 is removed by the cleaning blade 60 and the electric charges of the drum photoreceptor 10 are removed once by the discharging lamp 70.

Figure 4:
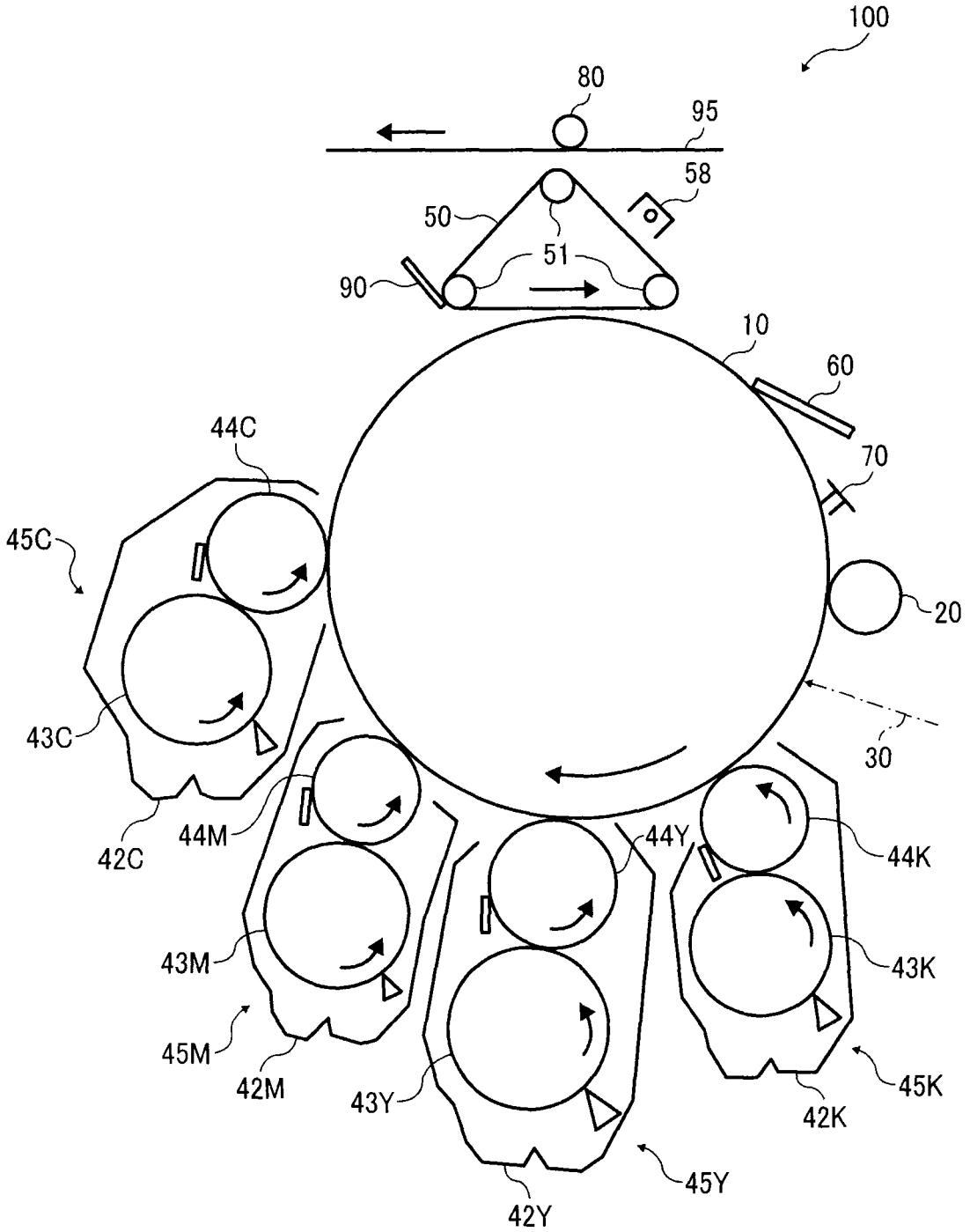
FIG. 4 is a schematic view illustrating another embodiment of the image forming apparatus of the present invention.

Another embodiment for conducting the image forming method of the present invention is described with reference to the image forming apparatus of FIG. 4. An image forming apparatus 100 illustrated in FIG. 4 has the same configuration as the image forming apparatus 100 illustrated in FIG. 3 except that the image forming apparatus 100 illustrated in FIG. 4 has no developing belt 41 serving as the development agent bearing member and the black developing unit 45K, yellow developing unit 45Y, magenta developing unit 45M, and cyan developing unit 45C are disposed directly facing the drum photoreceptor 10. In FIG. 4, the same parts as those in FIG. 3 are represented by the same reference numerals.

Figure 5:
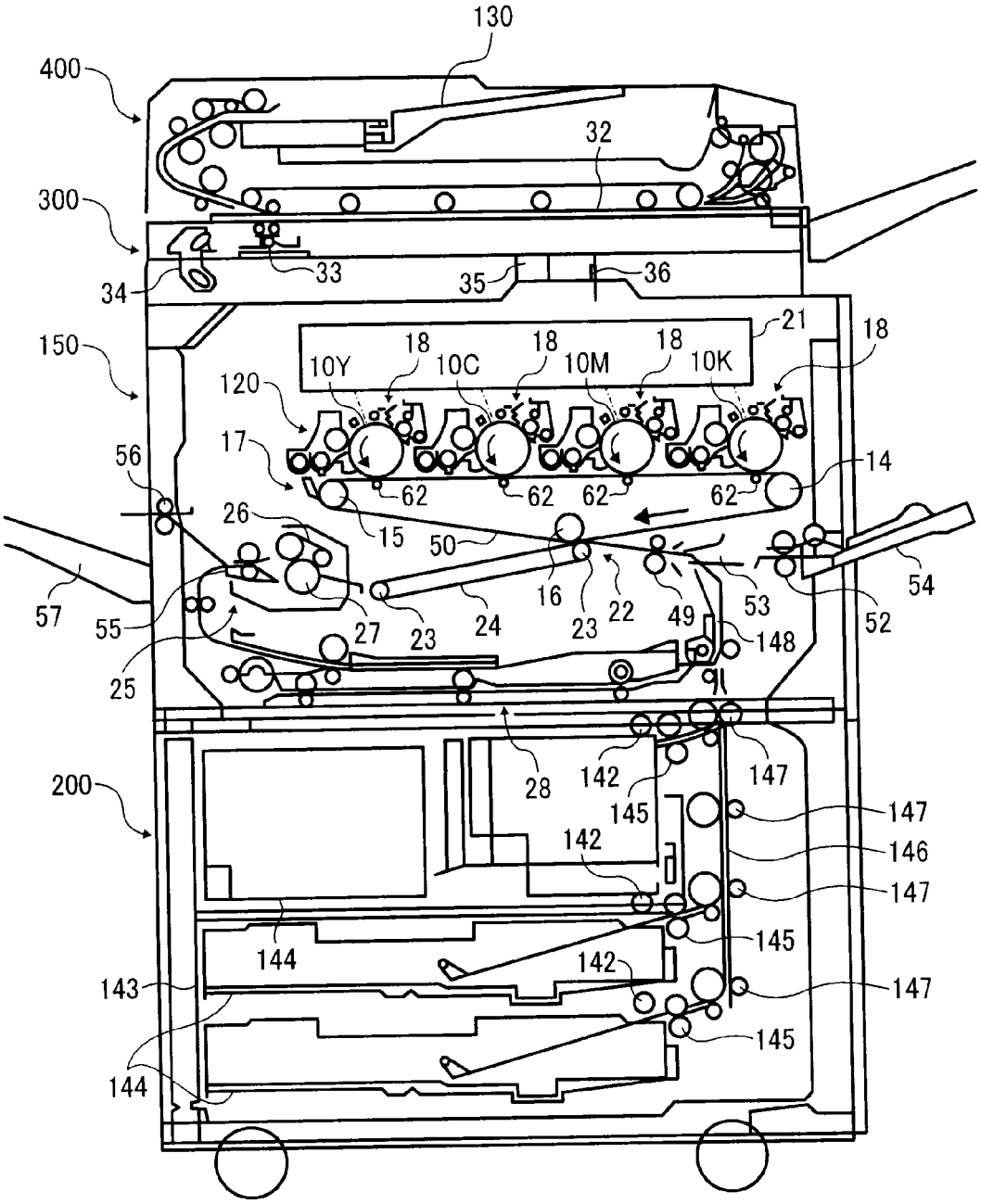
FIG. 5 is a schematic view illustrating a further embodiment of the image forming apparatus of the present invention.

A further embodiment of conducting the image forming method of the present invention is described with reference to FIG. 5. A tandem image forming apparatus 100 illustrated in FIG. 5 is a tandem type color image forming apparatus. The tandem image forming apparatus 100 has a main part 150, a paper feeding table 200, a scanner 300, and an automatic document feeder (ADF) 400.

The main part 150 has an intermediate transfer element 50 having an endless belt form disposed in the center thereof. The intermediate transfer element 50 is stretched by support rollers 14, 15, and 16 and designed to rotate clockwise in FIG. 5. An intermediate transfer cleaning device 17 is disposed in the vicinity of the support roller 15 to remove residual toner left on the intermediate transfer element 50. A tandem type developing unit 120 is provided which includes four (yellow, cyan, magenta, and black) image forming units 18 arranged side by side along the portion of the intermediate transfer element 50 which is stretched by the support rollers 14 and 15. An exposure device 21 is disposed in the vicinity of the tandem type developing unit 120. A secondary transfer device 22 is disposed around the intermediate transfer element 50 on the reverse side of the tandem type developing unit 120. In the secondary transfer device 22, a secondary transfer belt 24, which is an endless belt is stretched by a pair of rollers 23 and conveys the recording medium, so that the recording medium can contact the intermediate transfer element 50. A fixing device 25 is disposed in the vicinity of the secondary transfer device 22.

In the tandem image forming apparatus 100, a reversing unit 28 that changes the moving direction of the recording medium to form an image on each side of the recording medium is arranged in the vicinity of the secondary transfer device 22 and a fixing device 25.

Next, the formation of a full-color image by using the tandem type developing unit 120 is described. Specifically, an original document is set on the surface of a document holder 130 of the automatic document feeder (ADF) 400 or the automatic document feeder 400 is opened to set an original document on the surface of a contact glass 32 and then closed.

When a start switch is pressed, a scanner 300 is driven after the original document is conveyed and transferred to the surface of the contact glass 32 when the original document is set on the surface of the automatic document feeder 400 or instantly when the original document is set on the surface of the contact glass 32, to move a first carrier 33 and a second carrier 34. At this time, the first carrier 33 reflects light from a light source and the reflection from the original document is further reflected at the mirror of the second carrier 34. The reflection at the mirror of the second carrier 34 is received at a reading sensor 29 to read a color image (document), which is stored as image information of black, yellow, magenta, and cyan. The numeral references 31 represents a focusing lens.

Figure 6:
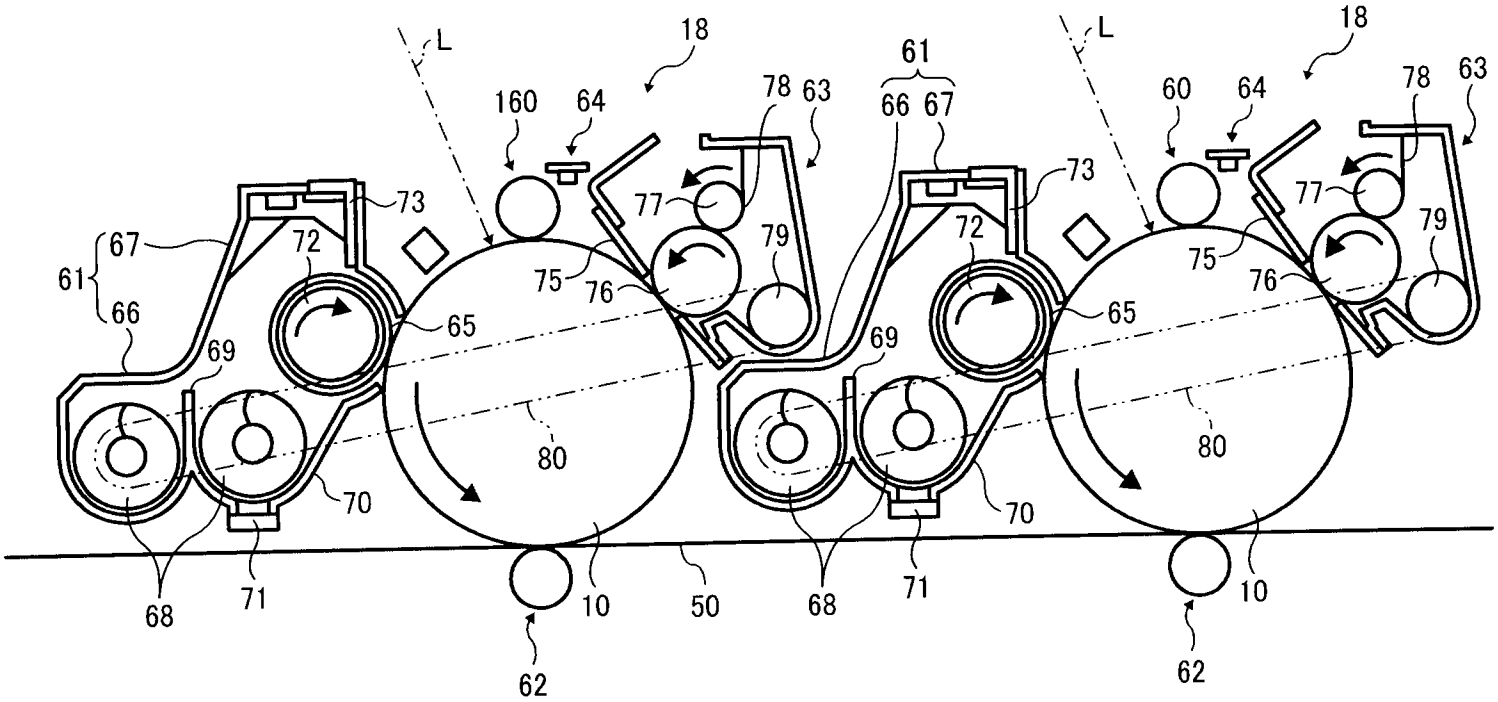
FIG. 6 is a partially amplified view of FIG. 5.

Then, each image information of black, yellow, magenta, and cyan is transmitted to corresponding image forming units 18 (black image forming unit, yellow image forming unit, magenta image forming unit, and cyan image forming unit) in the tandem type developing unit 120 to form each toner image of black, yellow, magenta, and cyan in each image forming unit. Specifically, as illustrated in FIG. 6, each image forming unit 18 (black image forming unit, yellow image forming unit, magenta image forming unit, and cyan image forming unit) in the tandem type developing unit 120 has a latent electrostatic image bearing member 10 (black latent electrostatic image bearing member 10K, yellow latent electrostatic image bearing member 10Y, magenta latent electrostatic image bearing member 10M, and cyan latent electrostatic image bearing member 10C), a charger 60 that uniformly charges the latent electrostatic bearing member 10, an irradiator that exposes the latent electrostatic image bearing member 10 with L illustrated in FIG. 6 according to the color image information to form a latent electrostatic image corresponding to each color image on the latent electrostatic image bearing member 10, a developing unit 61 that develops the latent electrostatic image by using each color toner (black toner, yellow toner, magenta toner, and cyan toner) to form a toner image of each color toner, a transfer charger 62 that transfers the toner image to the intermediate transfer element 50, a cleaning device 63, and a discharger 64, to form each single color image (black image, yellow image, magenta image, and cyan image) based on each color image formation. The black image, yellow image, magenta image, and cyan image formed in this manner, that is, the black image formed on the black latent electrostatic image carrier 10K, yellow image formed the yellow latent electrostatic image carrier 10Y, magenta image formed on the magenta latent electrostatic image bearing member 10M, and cyan image formed on the cyan latent electrostatic image bearing member 10C are transferred (primary transfer) one by one to the intermediate transfer element 50 which is rotationally transferred by the support rollers 14, 15, and 16. Then, the black image, yellow image, magenta image, and cyan image are superimposed sequentially on the intermediate transfer element 50 to form a synthetic color image (color transfer image).

In the paper feeding table 200, one of the paper feed rollers 142 is selectively rotated to draw a recording medium from one of multistage paper feed cassettes 144 provided in a paper bank 143. A separating roller 145 separates the recording media one by one by to feed each paper to a paper feed path 146. The recording medium is conveyed by a conveyer roller 147, introduced into a paper feed path 148 in the main part 150, strikes a registration roller 49, and is held there. Alternatively, the recording medium on a manual tray 54 is fed one by one by a separating roller 52, introduced into a manual paper feed path 53, strikes a registration roller 49, and is held there. Although the registration roller 49 is usually used in a grounded condition, a bias can be applied thereto to remove paper dust of the recording medium. Then, the registration roller 49 feeds the recording medium between the intermediate transfer element 50 and the secondary transfer device 22 by rotating in synchronization with the synthetic color image (color transfer image) synthesized on the intermediate transfer element 50. The secondary transfer device 22 secondarily transfers the synthetic color image (color transfer image) to the recording medium to form the color image thereon. Residual toner left on the intermediate transfer element 50 after the image transfer is removed by the intermediate transfer element cleaning device 17.

The recording medium onto which the color image is transferred is conveyed by the secondary transfer device 22 and fed to a fixing device 25 including a fixing belt 26 and pressure roller 27, where the synthetic color image (color transfer image) is fixed onto the recording medium by heat and pressure.

Among the fixing conditions, the fixing nip time influences the image gloss most. The fixing nip time is represented by fixing nip width/fixing linear speed. The nip time is preferably from 50 to 90 msec. When less than 50 msec, a heat is not fully transferred to a toner and the toner has low glossiness. The glossiness profile relative to the toner fixing temperature cannot be obtained. When longer than 90 msec, a difference between the minimum glossiness and the maximum glossiness becomes small, and it is difficult to properly use high gloss and low gloss. Further, hot offset tends to occur.

Then, the recording medium is turned by a switching claw 55, discharged by a discharge roller 56, and stuck on a paper discharge tray 57. Alternatively, the recording medium is turned by the switching claw 55, inversed by a reversing unit 28, introduced again into the transfer position to record an image on the backside thereof, then, discharged by the discharging roller 56, and stuck on the discharging tray 57.

On a surface of the recording medium on which the full-color image is formed or on the back surface thereof, a white image is formed by another image forming apparatus with the white toner of the present invention.

Figure 7:
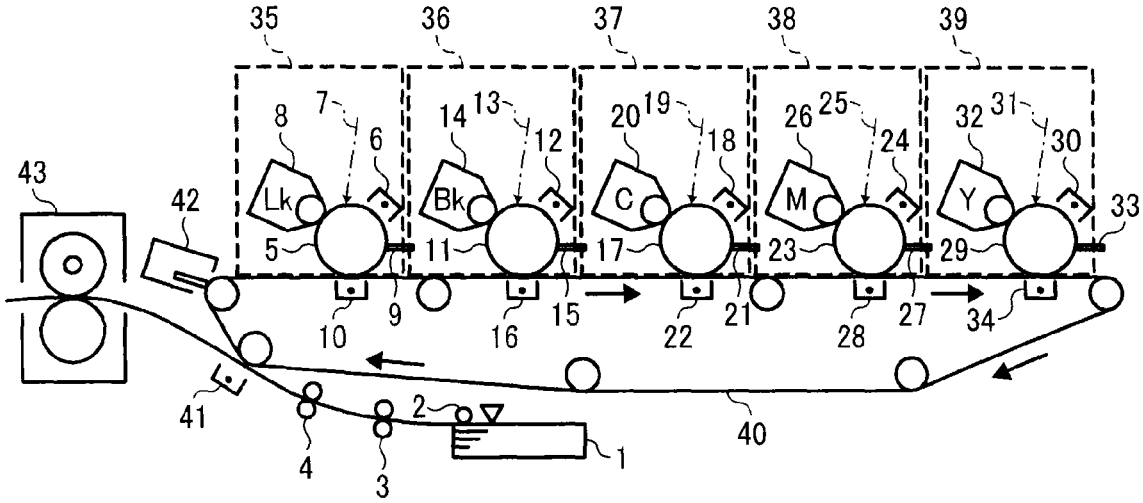
FIG. 7 is a schematic view illustrating an embodiment of the image forming apparatus capable of forming a white toner image and a full-color image of the present invention.

The mechanism of forming an image of the white toner on the full color image is described next. For example, an image forming apparatus having development units for five colors is used. FIG. 7 is a schematic diagram illustrating this image forming apparatus for five colors. A developing unit 35 uses white toner, a developing unit 36 uses black toner, a developing unit 37 uses cyan toner, a developing unit 38 uses magenta toner, and a developing unit 39 uses yellow toner to form an image in each developing unit. Each formed image is transferred to an intermediate transfer belt 40. The image on the intermediate transfer belt 40 is transferred to a transparent film or the like by a transfer device 41 and fixed by a fixing device 43. The reference numerals 1, 2, 3, 4, 5, and 6 represent a photoreceptor, a charger, a beam of light, a development unit, a cleaner, and a transfer charger, respectively. In this case, since the white toner layer forms the uppermost layer of the image, it is possible to view the full-color image from the side on which no image is formed. However, when using black or colored substrate (typically paper), the arrangement of the developing units is required to change to form a white layer first. Accordingly, the white developing unit is moved to the position of the yellow developing unit 39 to move the other developing units to the position of the adjacent developing from right to left.

The white toner of the present invention has (a) a temperature range not less than 25° C. in which 60° glossiness is 10 or less between a fixable minimum temperature and a fixable maximum temperature thereof; and (b) a temperature range not less than 25° C. in which 60° glossiness is from 30 to 60 therebetween.

In the fixing conditions, when a high gloss white image and a low gloss white image are formed, an image having a desired glossiness can be fixed by controlling the fixing temperature because both have sufficient fixable temperature ranges. Namely, according to a required glossiness, the fixing temperature is changed to form a high gloss white image and a low gloss white image.

In the present invention, it is possible to form images not only by using an image forming apparatus having five image developing units as illustrated in FIG. 7 but also by separate image forming apparatuses including, for example, a combination of a full-color MFP available in the market to form full color images and a monochrome MFP available in the market to form white images. The MFP means a photocopier capable of faxing and printing. This combination has advantages in terms of development because existing image forming apparatuses are usable by remodeling. In addition, since white images and full color images are formed by separate apparatuses, the toners are not mingled because a white image is formed on a fixed color image. This applies to the case in which a color image is formed on a fixed white image. However, the image forming apparatus illustrated in FIG. 7 superimposes an unfixed image on an unfixed image, which possibly causes a problem during transfer and fixing. Considering the white toner in particular has an adverse impact on coloring due to its masking property, avoiding of mingling of the toners is preferable.

(Process Cartridge)

The image forming apparatus of the present disclosure optionally has a process cartridge which integrally supports a latent electrostatic image bearing member and a developing device which at least develops an electrostatic image formed on the image bearing member by using the white toner of the present disclosure to form a visible image. The process cartridge is detachably attachable to the image forming apparatus and optionally has other devices such as a cleaning device.

Figure 8:
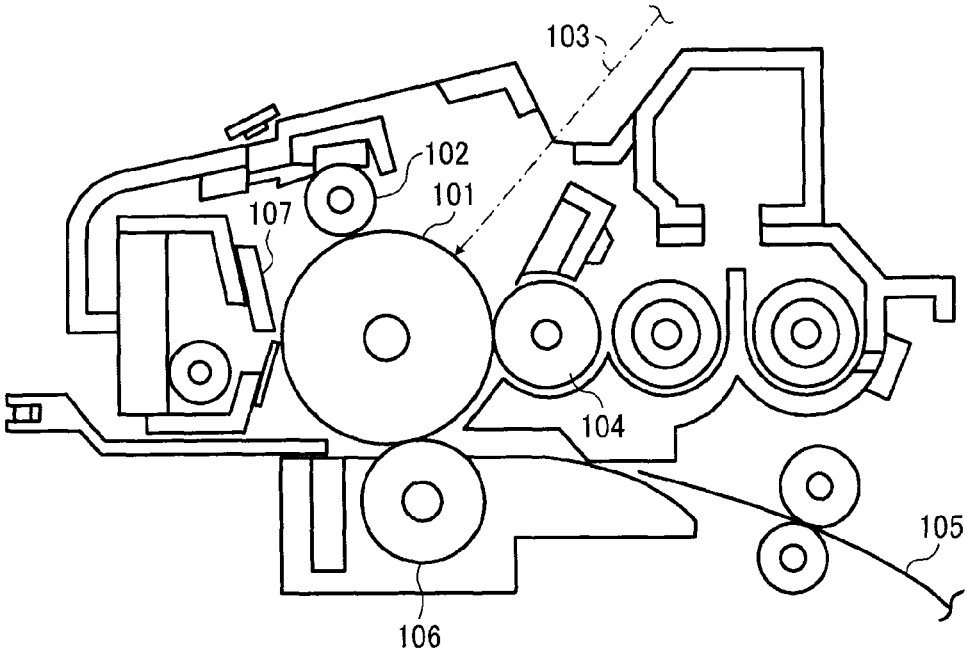
FIG. 8 is a schematic view illustrating an embodiment of process cartridge using the toner of the present invention.

FIG. 8 is a diagram illustrating an example of the process cartridge. This process cartridge has a built-in photoreceptor 101, a charger 102, an irradiator 103, a developing device 104, a transfer device 106, and a cleaning device 107. For these elements, the same members as those used in the image forming apparatus are usable.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Measurement of Binder Resin Molecular Weight (Mw)>

The number-average molecular weight and weight-average molecular weight of the binder resin were measured by a GPC measurer GPC-150C from Waters Corp. A column (KF801 to 807 from Shodex) is stabilized in a heat chamber having a temperature of 40° C.; THF is put into the column at a speed of 1 ml/min as a solvent; a sample having a concentration of from 0.05 to 0.6% by weight, is put into the column to measure a molecular weight distribution of the binder resin. From the molecular weight distribution thereof, the weight-average molecular weight and the number-average molecular weight of the binder resin are determined by using a calibration curve which is previously prepared using several polystyrene standard samples having a single distribution peak.

As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

<Acid Value Measurement of Toner and Binder Resin>

The acid values of the toner and the binder resin were measured by the method mentioned in JIS K0070-1992.

0.5 g of polyester is stirred in 120 ml of THF at a room temperature (23° C.) for 10 hrs to be dissolved therein, and 30 ml of ethanol is further added thereto to prepare a sample solution.

The following device is used to measure the acid value, and which is specifically determined as follows.

An N/10 caustic potassium-alcohol solution is titrated in the sample solution and the acid value is determined form a consumed amount of the caustic potassium-alcohol solution using the following formula:

Acid value=KOH(ml)×N×56.1/weight of the sample solution wherein N is N/10KOH factor.

Resins used in Examples and Comparative Examples of the present invention are polyester in the following Table 1.

TABLE 1

| | Mw | Acid Value Mg KOH/g | Tg | Manufacturer | Product Name |
|---|---|---|---|---|---|
| Polyester A | 6100 | 10 | 60° C. | Sanyo Chemical Industries, Ltd. | EXL-101 |

TABLE 1-continued

| | Mw | Acid Value Mg KOH/g | Tg | Manufacturer | Product Name |
|---|---|---|---|---|---|
| Polyester B | 14000 | 4 | 60° C. | Kao Corp. | RN-300 |
| Polyester C | 5300 | 15 | 63° C. | Kao Corp. | RN-263 |
| Polyester D | 5500 | 25 | 58° C. | Sanyo Chemical Industries, Ltd. | EXL-003 |
| Polyester E | 87000 | 33 | 62° C. | Kao Corp. | RN-290 |
| Polyester F | 25000 | 23 | 63° C. | Kao Corp. | RN-381 |
| Polyester G | 26000 | 12 | 62° C. | Sanyo Chemical Industries, Ltd. | SRCE-25 |
| Polyester H | 40000 | 10 | 62° C. | DIC Corp. | 07-6827 |

Example 1

Production Example of White Toner 1

| | |
|---|---|
| Polyester A | 72 |
| Polyester E | 18 |
| Titanium dioxide (Rutile titanium oxide PF-739 from Ishihara Sangyo Kaisha, Ltd.) | 70 |
| Synthesized monoester wax (LW-13 having a melting point of 70.5° C. from Sanyo Chemical Industries, Ltd.) | 6 |
| Wax dispersant (Styrene acrylic resin EXD-001 from Sanyo Chemical Industries, Ltd.) | 3 |
| Salicylic acid derivative zirconium salt (TN-105 from Hodogaya Chemical Co., Ltd.) | 1 |

having the following formula (1)

(1)

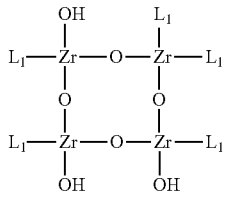

wherein $L_1$ has the following structure:

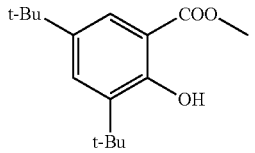

The above toner materials were preliminarily mixed by HENSCHEL MIXER (FM20B from Nippon Coke & Engineering Co., Ltd.), and the resultant mixture was melted and kneaded by a monoaxial kneader KO-KNEADER from Buss AG at from 100 to 130° C. The kneaded mixture was cooled to have a room temperature and pulverized by Rotoplex to have a size of from 200 to 300 μm. The pulverized mixture was further pulverized by a counter jet mill 100 AFG from Hosokawa Micron Corp. to have a weight-average particle diameter of 6.3±0.3 μm while the pulverizing air pressure was properly controlled. The further pulverized mixture was classified by an air stream classifier EJ-LABO from Matsubo Corp. to have a weight-average particle diameter of 7.0±0.2 μm and a ratio thereof to a number-average particle diameter not greater than 1.20 while louver opening was properly controlled. Thus, toner base particles A were prepared.

Examples 2 to 7 and Comparative Examples 1 to 6

Using materials in Table 2, toner base particles B to N were prepared as toner base particles A was.

Salicylic acid derivative aluminum has the following formula (2):

(2)

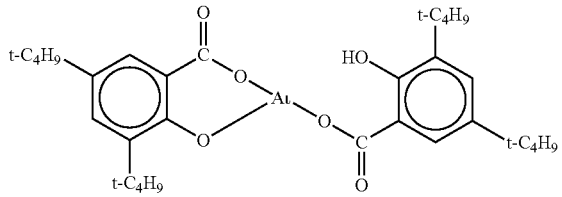

WA-05 from Cerarica Noda Co., Ltd. is a natural monoester wax.

Next, 100 parts of the toner base particles, 1.0 part of an additive fumed silica (REOLOSIL ZD-30ST from Tokuyama Corp.) and 0.75 parts of titanium oxide (MT-150Ai from Tayca Corp.) were mixed by HENSCHEL MIXER to prepare toners A to N.

(Preparation Examples of Two-Component Developer)

<Preparation of Carrier>

The following materials were mixed and dispersed by a homomixer for 20 min to prepare a coating liquid. The coating liquid was coated by a fluidized-bed coater on Mn ferrite particles having a weight-average particle diameter of 35 μm to have an average coated thickness of 0.20 μm at 70° C.

| | |
|---|---|
| Silicone Resin (Organo Straight Silicone) | 100 |
| Toluene | 100 |
| γ-(2-aminoethyl)aminopropyltrimethoxysilane | 5 |
| Carbon black | 10 |

The coated particles were burned in an electric oven at 180° C. for 2 hrs to prepare a carrier A.

<Preparation of Two-Component Developer>

The toner was uniformly mixed with the carrier A by TURBULA MIXER from Willy A. Bachofen (WAB) AG at 48 rpm for 5 min to be charged. Thus, a two-component developer was prepared. A mixing ratio of the toner to the carrier was 10% by weight in accordance with the toner concentration of the initial developer.

The fixable minimum temperature and the fixable maximum temperature of the toner were measured, and 60° glossiness in a range from the fixable minimum temperature and the fixable maximum temperature.

The fixable minimum temperature and the fixable maximum temperature of the toner were measured by the following methods.

<Fixable Minimum Temperature>

On a copy print paper <70> from Ricoh Business Expert Co., Ltd., a solid image having a size of 3 cm×8 cm and a toner adherence amount of 0.85±0.1 mg/cm$^2$ was formed by an electrophotographic copier MF-200 from Ricoh Company, Ltd., using a TEFLON (trade name) roller as a fixing roller in which the fixer was modified. The temperature of the fixing belt was changed to fix the image. Next, the surface of a fixed image was scratched with a ruby needle having a tip radius of from 260 to 320 μm and a tip angle of 60° at 50 g load using a scratch drawing tester AD-401 (from Ueshima Seisakusho Co., Ltd.). The scratched surface of the fixed image was abraded 5 times with a fiber Honeycott #440 from Honeyron. The lowest fixable temperature without damage of image was the fixable minimum temperature. The solid image was formed at a position of 3.0 cm from the end of paper in its feed direction and the paper passed a nip of the fixer at a speed of 280 mm/s.

<Fixable Maximum Temperature>

On a copy print paper <70> from Ricoh Business Expert Co., Ltd., a solid image having a size of 3 cm×8 cm and a toner adherence amount of 0.85±0.1 mg/cm$^2$ was formed by an electrophotographic copier MF-200 from Ricoh Company, Ltd., using a TEFLON (trade name) roller as a fixing roller in which the fixer was modified. The temperature of the fixing belt was changed to fix the image. Next, whether hot offset occurred on the fixed image was observed with a magnifier. The highest fixable temperature without occurrence of hot offset was fixable maximum temperature. The solid image was formed at a position of 3.0 cm from the end of paper in its feed direction and the paper passed a nip of the fixer at a speed of 280 mm/s.

<Glossiness>

With each of the developers, a solid image having a size of 4 cm×4 cm and a toner adherence amount of 0.85±0.1 mg/cm$^2$ was formed on COTED glossy paper from mondi having a weight of 135 g/m$^2$ by a modified digital full-color complex machine Imagio Neo C600 having a linear speed of 180 mm/sec, a nip width of 11.3 mm, a nip pressure 37N/cm$^2$ and a nip time 62 msec. The 60° glossiness of each of images fixed at every 5° C. from the fixable minimum temperature to the fixable maximum temperature was measured. The glossiness of 5 points of each image was measured by using a gloss meter VGS-1D from Nippon Denshoku Industries Co., Ltd., according to JIS-Z8781 (1983 method 3). An average of the glossiness of the 3 points except for the maximum value and the minimum was the glossiness of the image.

The glossiness variation of each fixing temperature was plotted to analyze the profile. The results are shown in Table 3.

TABLE 2

| | Example 1 Toner A | Example 2 Toner B | Example 3 Toner C | Example 4 Toner D |
|---|---|---|---|---|
| Low-Molecular-Weight Polyester (LP) | Polyester A | Polyester A | Polyester B | Polyester B |
| Parts | 72 | 63 | 81 | 72 |
| Polymeric Polyester (PP) | Polyester E | Polyester F | Polyester E | Polyester F |
| Parts | 18 | 27 | 9 | 18 |
| White Pigment | PF-739 | PF-739 | PF-739 | PF-739 |
| parts | 70 | 70 | 70 | 70 |
| Tri- or more valent Metal Salt | Salicylic Acid Derivative Zirconium | Salicylic Acid Derivative Zirconium | Salicylic Acid Derivative Aluminum | Salicylic Acid Derivative Aluminum |
| Parts | 1 | 1 | 1 | 1 |
| Wax | LW-13 from Sanyo Chemical | LW-13 from Sanyo Chemical | WA-05 from Cerarica Noda | WA-05 from Cerarica Noda |
| Parts | 6 | 6 | 6 | 6 |
| Wax Dispersant | EXD-001 from Sanyo Chemical | EXD-001 from Sanyo Chemical | EXD-001 from Sanyo Chemical | EXD-001 from Sanyo Chemical |
| Parts | 3 | 3 | 3 | 3 |
| LP/PP | 80/20 | 70/30 | 90/10 | 80/20 |

| | Example 5 Toner E | Example 6 Toner F | Example 7 Toner G | Comparative Example 1 Toner H |
|---|---|---|---|---|
| Low-Molecular-Weight Polyester (LP) | Polyester A | Polyester A | Polyester A | Polyester A |
| Parts | 72 | 72 | 63 | 72 |
| Polymeric Polyester (PP) | Polyester E | Polyester E | Polyester F | Polyester H |
| Parts | 18 | 18 | 27 | 18 |
| White Pigment | PF-739 | PF-739 | PF-739 | PF-739 |
| parts | 80 | 60 | 80 | 70 |
| Tri- or more valent Metal Salt | Salicylic Acid Derivative Zirconium | Salicylic Acid Derivative Zirconium | Salicylic Acid Derivative Zirconium | Salicylic Acid Derivative Zirconium |
| Parts | 1 | 1 | 1 | 1 |
| Wax | LW-13 from Sanyo Chemical | LW-13 from Sanyo Chemical | LW-13 from Sanyo Chemical | LW-13 from Sanyo Chemical |
| Parts | 6 | 6 | 6 | 6 |
| Wax Dispersant | EXD-001 from Sanyo Chemical | EXD-001 from Sanyo Chemical | EXD-001 from Sanyo Chemical | EXD-001 from Sanyo Chemical |
| Parts | 3 | 3 | 3 | 3 |
| LP/PP | 80/20 | 80/20 | 70/30 | 80/20 |

TABLE 2-continued

| | Comparative Example 2 Toner I | Comparative Example 3 Toner J | Comparative Example 4 Toner K | Comparative Example 5 Toner L |
|---|---|---|---|---|
| Low-Molecular-Weight Polyester (LP) | Polyester A | Polyester B | Polyester C | Polyester D |
| Parts | 63 | 72 | 72 | 72 |
| Polymeric Polyester (PP) | Polyester G | Polyester G | Polyester E | Polyester E |
| Parts | 27 | 18 | 18 | 18 |
| White Pigment | PF-739 | PF-739 | PF-739 | PF-739 |
| parts | 80 | 60 | 80 | 70 |
| Tri- or more valent Metal Salt | Salicylic Acid Derivative Zirconium | Salicylic Acid Derivative Aluminum | Salicylic Acid Derivative Zirconium | Salicylic Acid Derivative Zirconium |
| Parts | 1 | 1 | 1 | 1 |
| Wax | LW-13 from Sanyo Chemical | WA-05 from Cerarica Noda | WA-05 from Cerarica Noda | LW-13 from Sanyo Chemical |
| Parts | 6 | 6 | 6 | 6 |
| Wax Dispersant | EXD-001 from Sanyo Chemical | EXD-001 from Sanyo Chemical | EXD-001 from Sanyo Chemical | EXD-001 from Sanyo Chemical |
| Parts | 3 | 3 | 3 | 3 |
| LP/PP | 70/30 | 80/20 | 80/20 | 80/20 |

| | Comparative Example 6 Toner M | Comparative Example 7 Toner N |
|---|---|---|
| Low-Molecular-Weight Polyester (LP) | Polyester A | Polyester B |
| Parts | 72 | 63 |
| Polymeric Polyester (PP) | Polyester E | Polyester F |
| Parts | 18 | 27 |
| White Pigment | PF-739 | PF-739 |
| parts | 70 | 70 |
| Tri- or more valent Metal Salt | — | — |
| Parts | 0 | 0 |
| Wax | LW-13 from Sanyo Chemical | WA-05 from Cerarica Noda |
| Parts | 6 | 6 |
| Wax Dispersant | EXD-001 from Sanyo Chemical | EXD-001 from Sanyo Chemical |
| Parts | 3 | 3 |
| LP/PP | 80/20 | 70/30 |

TABLE 3

| | | Temperature Width of 60° Glossiness not greater than 10 | Temperature Width of 60° Glossiness of from 30 to 60 |
|---|---|---|---|
| Example 1 | Toner A | 35 | 30 |
| Example 2 | Toner B | 40 | 25 |
| Example 3 | Toner C | 30 | 25 |
| Example 4 | Toner D | 40 | 25 |
| Example 5 | Toner E | 35 | 30 |
| Example 6 | Toner F | 35 | 25 |
| Example 7 | Toner G | 40 | 30 |
| Comparative Example 1 | Toner H | 20 | 20 |
| Comparative Example 2 | Toner I | 15 | 15 |
| Comparative Example 3 | Toner J | 20 | 20 |
| Comparative Example 4 | Toner K | 50 | 0 |
| Comparative Example 5 | Toner L | 50 | 0 |
| Comparative Example 6 | Toner M | 20 | 20 |

TABLE 3-continued

| | | Temperature Width of 60° Glossiness not greater than 10 | Temperature Width of 60° Glossiness of from 30 to 60 |
|---|---|---|---|
| Example 6 Comparative Example 7 | Toner N | 20 | 10 |

It was proved that each of Examples 1 to 7 (Toners A to G) has a temperature range not less than 25° C. in which 60° glossiness is 10 or less between a fixable minimum temperature and a fixable maximum temperature thereof, and a temperature range not less than 25° C. in which 60° glossiness is from 30 to 60 therebetween. Namely, one toner stably provides both of a high gloss image and a low gloss image by controlling the temperature of the fixer.

Continuous 100 high gloss images having 60° glossiness of 48±2 were stably produced by the image forming apparatus in FIG. 7 with the toner A of Example 1 at a fixing temperature of 180° C., and continuous 100 low gloss images having 60° glossiness of 6±1 were stably produced at 140° C. 180° C. is 10° C. higher than the fixable maximum temperature and 140° C. is 10° C. higher than the fixable minimum temperature.

The toners of Comparative Examples 1 to 7 has a narrow temperature range in which 60° glossiness is 10 or less or from 30 to 60, and it is difficult to stably produce images having a specific glossiness only by controlling the temperature of the fixer.

Having now fully described the invention, it will be apparent to one of ordinary skill in the art that many changes and modifications can be made thereto without departing from the spirit and scope of the invention as set forth therein.

What is claimed is:

1. A white toner, comprising:

a first binder resin having a weight-average molecular weight of from 6,000 to 14,000 and an acid value of not greater than 12 mg KOH/g;

a second binder resin having a weight-average molecular weight of from 25,000 to 90,000 and an acid value of not less than 20 mg KOH/g;

a tri- or more valent metal salt; and a titanium dioxide white pigment, wherein a weight ratio of the first binder resin to the second binder resin is from 70/30 to 90/10.

2. The white toner of claim 1, wherein the white toner has a first temperature range and a second temperature range between a fixable minimum temperature and a fixable maximum temperature, an image formed by the white toner at a first temperature in the first temperature range has a 60° glossiness of 10 or less, an image formed by the white toner at a second temperature in the second temperature range has a 60° glossiness of from 30 to 60, and each of the first and second temperature ranges has a width of not less than 25° C.

3. The white toner of claim 1, wherein each of the first binder resin and the second binder resin is a polyester resin.

4. An image forming method, comprising:

charging a surface of a photoreceptor;

irradiating the surface of the photoreceptor with imagewise light to form an electrostatic latent image thereon;

developing the electrostatic latent image with the white toner of claim 1 to form a white toner image on the photoreceptor;

transferring the white toner image onto a recording medium; and fixing the white toner image on the recording medium.

5. An image forming apparatus, comprising:

a photoreceptor;

a charger configured to charge a surface of the photoreceptor;

an irradiator configured to irradiate the surface of the photoreceptor with imagewise light to form an electrostatic latent image thereon;

an image developer configured to develop the electrostatic latent image with the white toner of claim 1 to form a white toner image on the photoreceptor;

a transferer configured to transfer the white toner image onto a recording medium; and a fixer configured to fix the white toner image on the recording medium.

6. The white toner of claim 1, further comprising:

a crystalline polyester having a melting point of from 60 to 110° C.

7. The white toner of claim 1, wherein the tri- or more valent metal salt comprises a tri- or more valent salicylic acid metal compound.

8. The white toner of claim 1, wherein the first and second binder resins have a glass transition temperature of from 40 to 75° C.

9. The white toner of claim 1, wherein the titanium dioxide white pigment is included in the white toner in an amount of from 37 to 45% by weight.

10. The white toner of claim 1, wherein the titanium dioxide white pigment is surface treated with a polyol.

11. The white toner of claim 1, further comprising:

a release agent comprising an monoester wax; and a wax dispersant.

12. The white toner of claim 1, wherein the first binder resin has the weight-average molecular weight of from 6,100 to 14,000, and the acid value of from 4 to 10 mg KOH/g, and the second binder resin has the weight-average molecular weight of from 25,000 to 87,000, and the acid value of from 23 to 33 mg KOH/g.

13. The white toner of claim 11, wherein an amount of the first binder resin included in the white toner is from 63 to 81 parts by mass per 100 parts by mass of a total of the first and second binder resins, the tri- or more valent metal salt, the release agent, and the wax dispersant, and an amount of the second binder resin included in the white toner is from 9 to 27 parts by mass per 100 parts by mass of the total of the first and second binder resins, the tri- or more valent metal salt, the release agent, and the wax dispersant.

14. The white toner of claim 1, wherein the titanium dioxide white pigment has a volume-average particle diameter of from 200 to 300 nm.

15. The white toner of claim 1, further comprising:

an external additive comprising an inorganic particulate.

16. The white toner of claim 6, wherein the first and second binder resins have a glass transition temperature of from 40 to 75° C.

17. The white toner of claim 12, wherein an amount of the first binder resin included in the white toner is from 63 to 81 parts by mass per 100 parts by mass of a total of the first and second binder resins, the tri- or more valent metal salt, the release agent, and the wax dispersant, and an amount of the second binder resin included in the white toner is from 9 to 27 parts by mass per 100 parts by mass of the total of the first and second binder resins, the tri- or more valent metal salt, the release agent, and the wax dispersant.

18. The white toner of claim 2, further comprising:

a crystalline polyester having a melting point of from 60 to 110° C.

19. The white toner of claim 6, wherein the crystalline polyester has an endothermic peak temperature of from 65 to 75° C.

20. A developing agent, comprising:

the toner of claim 1; and a carrier, wherein the development agent includes the carrier in an amount of from 1 to 15 parts by weight per 100 parts by weight of the carrier.

* * * * *